US011173343B2

(12) United States Patent
Lee

(10) Patent No.: US 11,173,343 B2
(45) Date of Patent: Nov. 16, 2021

(54) STRENGTH TRAINING EQUIPMENT

(71) Applicant: CHI HUA FITNESS CO., LTD., Hsinchu County (TW)

(72) Inventor: Chia-Jung Lee, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 183 days.

(21) Appl. No.: 16/744,304

(22) Filed: Jan. 16, 2020

(65) Prior Publication Data

US 2021/0220703 A1 Jul. 22, 2021

(51) Int. Cl.
*A63B 24/00* (2006.01)
*A63B 21/005* (2006.01)
*A63B 21/00* (2006.01)

(52) U.S. Cl.
CPC ..... *A63B 24/0087* (2013.01); *A63B 21/0058* (2013.01); *A63B 21/153* (2013.01); *A63B 21/154* (2013.01); *A63B 2024/0093* (2013.01); *A63B 2220/16* (2013.01); *A63B 2220/805* (2013.01); *A63B 2220/833* (2013.01)

(58) Field of Classification Search
CPC ..... A63B 24/0087; A63B 21/0058; A63B 21/153; A63B 21/154; A63B 2220/833; A63B 2220/16; A63B 2024/0093; A63B 2220/805; A63B 21/15; A63B 21/151; A63B 21/152; A63B 21/155; A63B 21/156; A63B 21/157; A63B 21/158; A63B 21/159
See application file for complete search history.

(56) References Cited

U.S. PATENT DOCUMENTS 4,184,678 A * 1/1980 Flavell ..... A63B 21/153 482/6
4,979,733 A * 12/1990 Prud'Hon ..... A63B 21/0058 482/4
5,433,678 A * 7/1995 Chi ..... A63B 21/0058 482/1
10,179,265 B2 * 1/2019 Carr ..... A63B 21/4043
2016/0101322 A1 * 4/2016 Potter ..... A63B 21/002 482/6

* cited by examiner

*Primary Examiner* — Nyca T Nguyen
*Assistant Examiner* — Andrew M Kobylarz
(74) *Attorney, Agent, or Firm* — Rosenberg, Klein & Lee

(57) ABSTRACT

A strength training equipment, comprising: a torque producing mechanism, a weight pulling mechanism, a controller, and an electronic instrument; wherein the torque producing mechanism is composed of the deceleration machine and the winding wheel connected to each other on the same shaft, a belt is winding on the winding wheel, and the free end of the belt is connected to the force applied unit of the weight pulling mechanism; a movement path sensor installed on the winding wheel, and an angle sensor installed at the lateral side of the guide pulley of the weight pulling mechanism; whereby inputting required torque value by electronic instrument, the servo control unit will drive the motor to produce torque, the user will have to against the torque while applying force to the extension element and the swinging element, so achieve the effect of strength training.

3 Claims, 9 Drawing Sheets

STRENGTH TRAINING EQUIPMENT

BACKGROUND OF THE INVENTION

1. Field of the Invention

The invention relates to a strength training equipment, especially to one that has a motor providing linear moment to replace a traditional iron weight plate as a load element and has a servo control unit performing a curved load control and appropriately compensating a load current.

2. Description of the Related Art

Regardless of recreation, health or professional reasons, fitness exercise is an important part of our life. For example, strength trainers become very popular in developed countries in Europe and America, and iron weight plates are used to build up muscles, promote physiological functions, and maintaining good health. Thus, the iron weight plate is called a "weight strength trainer", whose structure is shown in FIG. 1A. Such conventional strength trainer has the following shortcomings:

1. The iron weight plate 911 comes with a large volume and occupies much space, it will take much time and effort for the user to make the adjustment.
2. If the load such as the iron weight plate 911 is lifted by a transmission cable 912 and then released slowly, an annoying sound will be produced, and the irritating sound will cause discomfort to the exerciser.
3. The load cannot be changed by setting an exercise curve, as a result, the exercising function is limited.

In view of the aforementioned shortcomings of the prior art, the inventor of the present invention has provided a powered strength trainer 920 as disclosed in U.S. Pat. No. 7,682,287 B1. As FIG. 1B shown, comprising: a frame 910, a motor 931, a transmission element 932, a winch 933, a steel wire 934, a load element 930, a controller 940 with a built-in control circuit, and a muscle extension element 922 connected to an end of a steel wire 934; the invention improves the defects in "weight strength trainer", whose structure is shown in FIG. 1A. However, reviewing the mechanism shown in FIG. 1B, the aforementioned prior arts still have the following drawbacks:

1. During the process of force applying, the transmission element 932 slide, and affect the training effect.
2. The motor 931 and the winch 933 are not in the same shaft, taking up a large space.
3. The structure is only suitable for extension strength training, lack of the mechanism for swinging strength training, the exercising function is limited.

SUMMARY OF THE INVENTION

It is a primary objective of the present invention to provide a strength training equipment having a torque producing mechanism drove by motor to replace a conventional iron weight plate, and the motor, the deceleration machine, and the winding wheel are connected to each other in the same shaft, so as to reduce transmission loss and achieve integral structure and reducing taking up space.

It is another objective of the present invention to provide a strength training equipment having spiral spring producing torque in opposite direction to the main shaft of the spiral spring, and without driving the shaft center to spin when the main shaft is rewound.

It is another objective of the present invention to provide a strength training equipment having sensors connected to the controller and using the servo control unit performing a curved load control and appropriately compensating a load current to provide a smooth and real-world setting to users.

It is another objective of the present invention to provide a strength training equipment having a force applied unit connected to a swinging element, makes the training functions have not only extension mode but also swinging mode.

In order to achieve the above objectives, the present invention includes a torque producing mechanism, having a motor, a deceleration machine, and a winding wheel, each of them is fixed on a base plate and connected to each other on the same shaft; wherein the motor is a direct current (DC) motor or a brushless motor which shaft center connected to a speed change gear train of the deceleration machine, the deceleration machine having a protruding output shaft with an one-way bearing set in an shaft hole of the winding wheel; a belt winding the winding wheel and connecting to a steel wire at the free end, while the steel wire is pulled by the applied force, the motor outputs torque in the opposite direction of the applied force to the steel wire; a fixing bracket surrounded the winding wheel, on the top of the fixing bracket set an opening hole making the free end of the belt able to pass through; on the lateral side of the winding wheel set a main shaft for connecting the inner end part of a spiral spring, and the outer end part fixed on the fixing bracket, when the winding wheel is spun by the belt pulling, the winding wheel will tighten the spiral spring and apply torque in opposite direction to the main shaft, and when the main shaft rewinding, the one-way bearing set in the shaft hole of the winding wheel will stop the output shaft of the deceleration machine from operating, will not drive the shaft center of the motor to spin, and when the belt stops pulling, the winding wheel will rewind the belt immediately.

A weight pulling mechanism having multiple guide pulleys and a force applied unit, the steel wire surrounded the guide pulley and the force applied unit connected to the free end makes the torque output by the motor transmit to the force applied unit, the force applied unit can be connected to an extension element or a swinging element; a controller with the controlling circuit built-in having: a servo control unit, an algorithmic unit, a DC motor driver, a spinning encoder interface, and an angle sensor interface, the controller is electrically connected to the motor to adjust the electric current and transmit the signal to the motor and further control the torque of the motor; an electronic instrument electrically connected to the controller for inputting the load value and showing the status of movement path.

A movement path sensor, including an optical interrupt disk installed at a lateral side of the winding wheel and linked to the winding wheel, and a pair of optical couplers installed at the periphery of the optical interrupt disk, the optical couplers are electrically connected to the controller, when applying force to the extension element, making the belt drive the winding wheel and the optical couplers to spin synchronously, and the pulse signal produced by the optical couplers will be transmitted to the spinning encoder interface inside the controller; an angle sensor arranged beside the guide pulley of the weight pulling mechanism, and the angle sensor is electrically connected to the controller, when applying force to the swinging element, will make the steel wire drive the guide pulley to spin, then the angle pulse signal will be transmitted to the angle sensor interface inside the controller.

Whereby inputting required torque value by electronic instrument, the servo control unit will drive the DC motor driver to produce load current, and further drive the motor to spin and output a torque, the user will have to against the torque while applying force to the extension element and the swinging element, so achieve the effect of strength training; meanwhile, the pulse signal produced by the optical couplers or the angle sensor will be transmitted to the spinning encoder interface or the angle sensor interface, after calculating by the algorithmic unit, the servo control unit performs a curved load control and appropriately compensate a load current to provide a smooth and real-world setting to users.

Furthermore, the present invention further includes a microswitch arranged beside the opening hole of the fixing bracket, by sensing the movement distance of the belt, the microswitch switch on or switch off the motor immediately.

Also, the present invention further includes a cover covering the spiral spring for protection.

Also, the present invention has benefits as below:

1. In the present invention, a strength training equipment having a torque producing mechanism drove by motor to replace a conventional iron weight plate, and the motor, the deceleration machine, and the winding wheel are connected to each other in the same shaft; since there is no need to drive through the belt pulley, the present invention reduces the transmission loss and achieves integral structure and reducing taking up space.
2. In the present invention, the deceleration machine having a protruding output shaft with an one-way bearing set in a shaft hole of the winding wheel, the outer end part fixed on the fixing bracket to form a hook, when the winding wheel is spun by the belt pulling, the winding wheel will tighten the spiral spring and apply torque in opposite direction to the main shaft, when the belt stops pulling, the winding wheel will rewind the belt immediately, and when the main shaft rewinding, the one-way bearing set in the shaft hole of the winding wheel will stop the output shaft of the deceleration machine from operating, will not drive the shaft center of the motor to spin so achieves the effect of protecting shaft center.
3. In the present invention, a movement path sensor arranged beside the winding wheel electrically connected to the spinning encoder interface of the controller, and beside the guide pulley of the weight pulling mechanism arranged an angle sensor electrically connected to the angle sensor interface; when the force applied to the force applied unit, it will make the winding wheel and the guide pulley to spin, the movement path sensor and the angle sensor produce pulse signal for the servo control unit performing a curved load control and appropriately compensating a load current to provide a smooth and real-world setting to users.
4. In the present invention, the force applied unit of the weight pulling mechanism can be connected to an extension element or a swinging element, the extension element allows the user to do extension training, and the swinging element allows the user to do swinging training, makes the training functions have not only extension mode but also swinging mode.

DETAILED DESCRIPTION OF THE PREFERRED EMBODIMENT

Figure 1A:
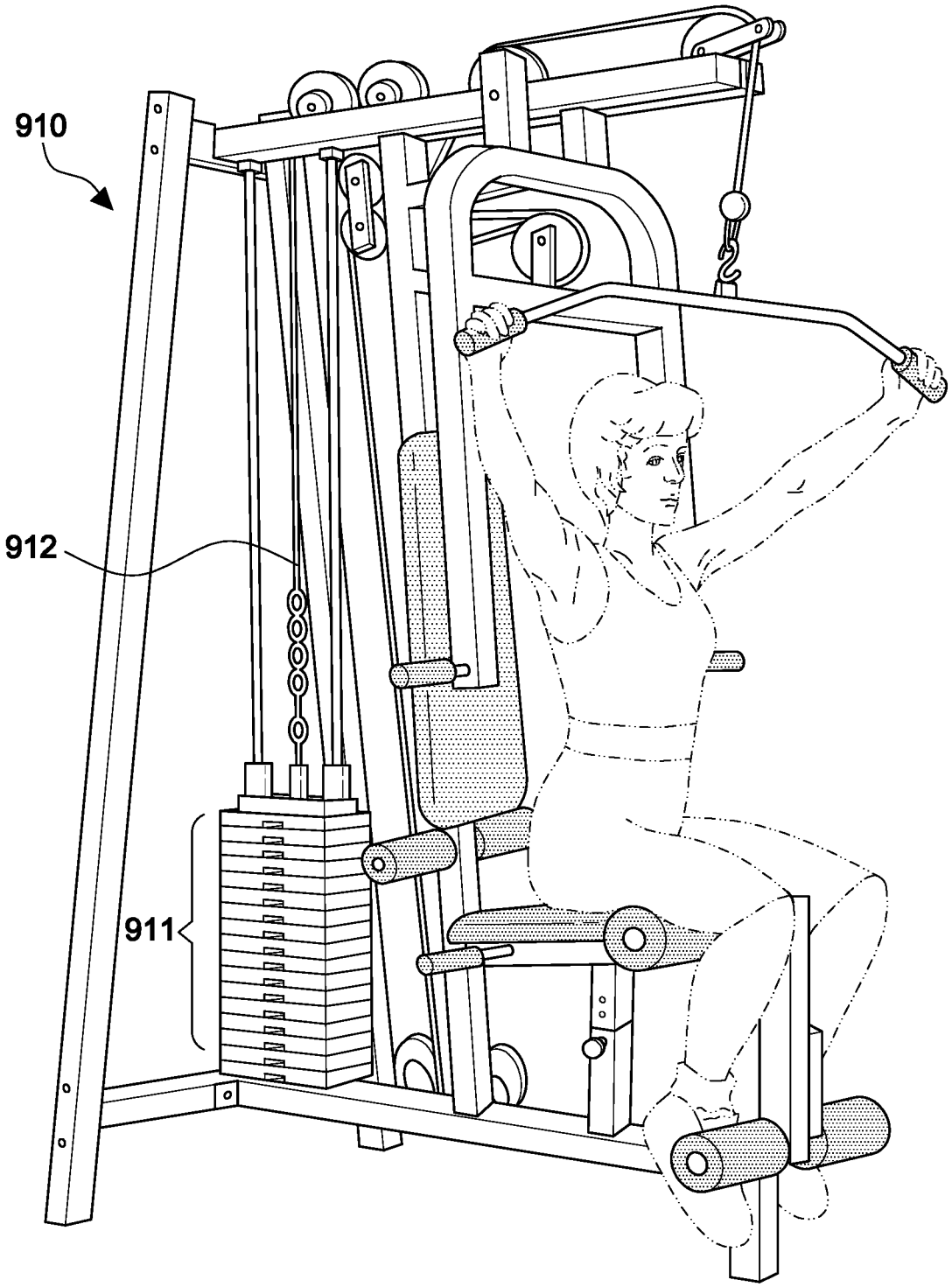
FIG.1A PRIOR ART
FIG. 1A is a schematic diagram illustrating structure of the prior art.
Figure 1B:
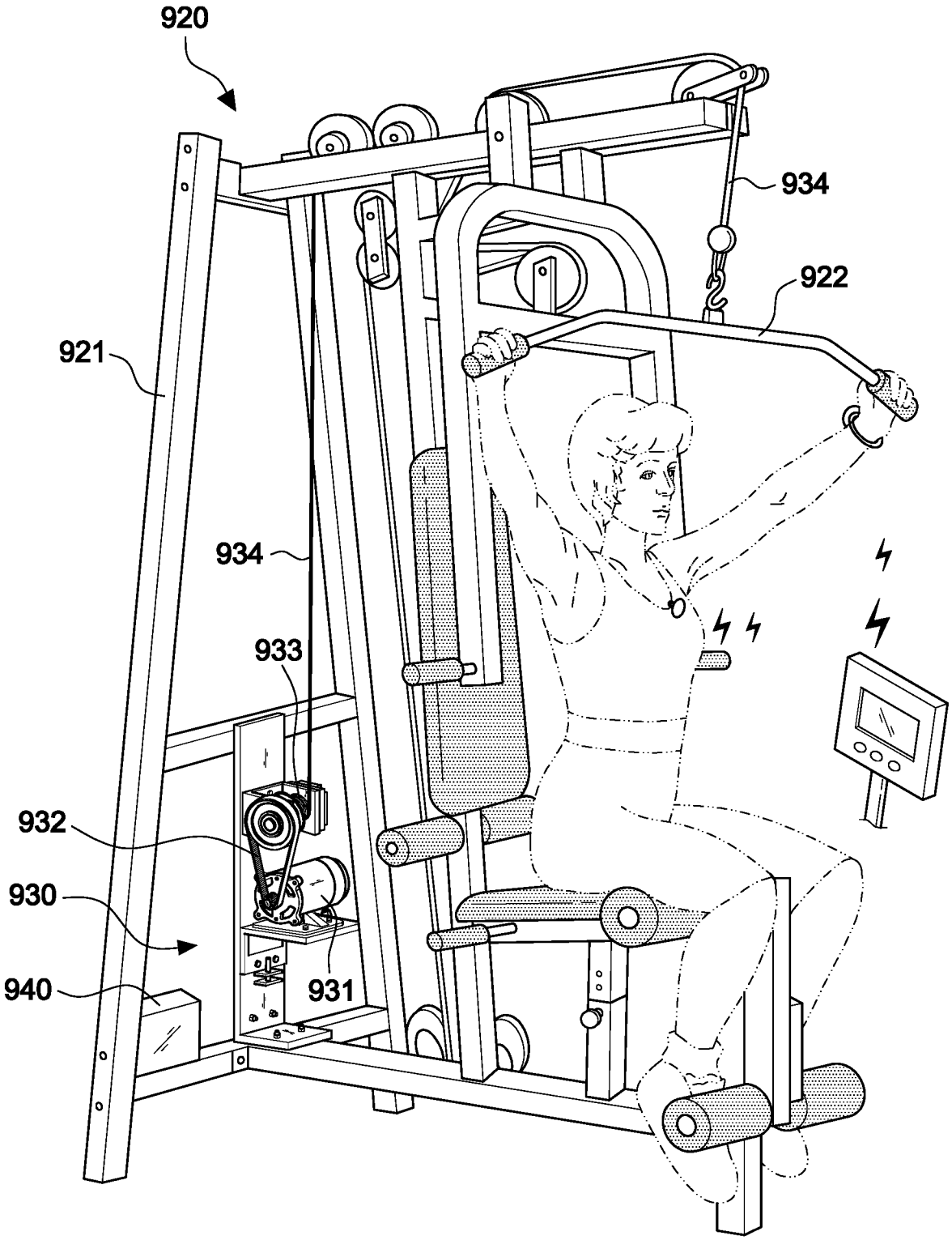
FIG.1B PRIOR ART
FIG. 1B is a schematic diagram illustrating structure of another prior art.
Figure 2:
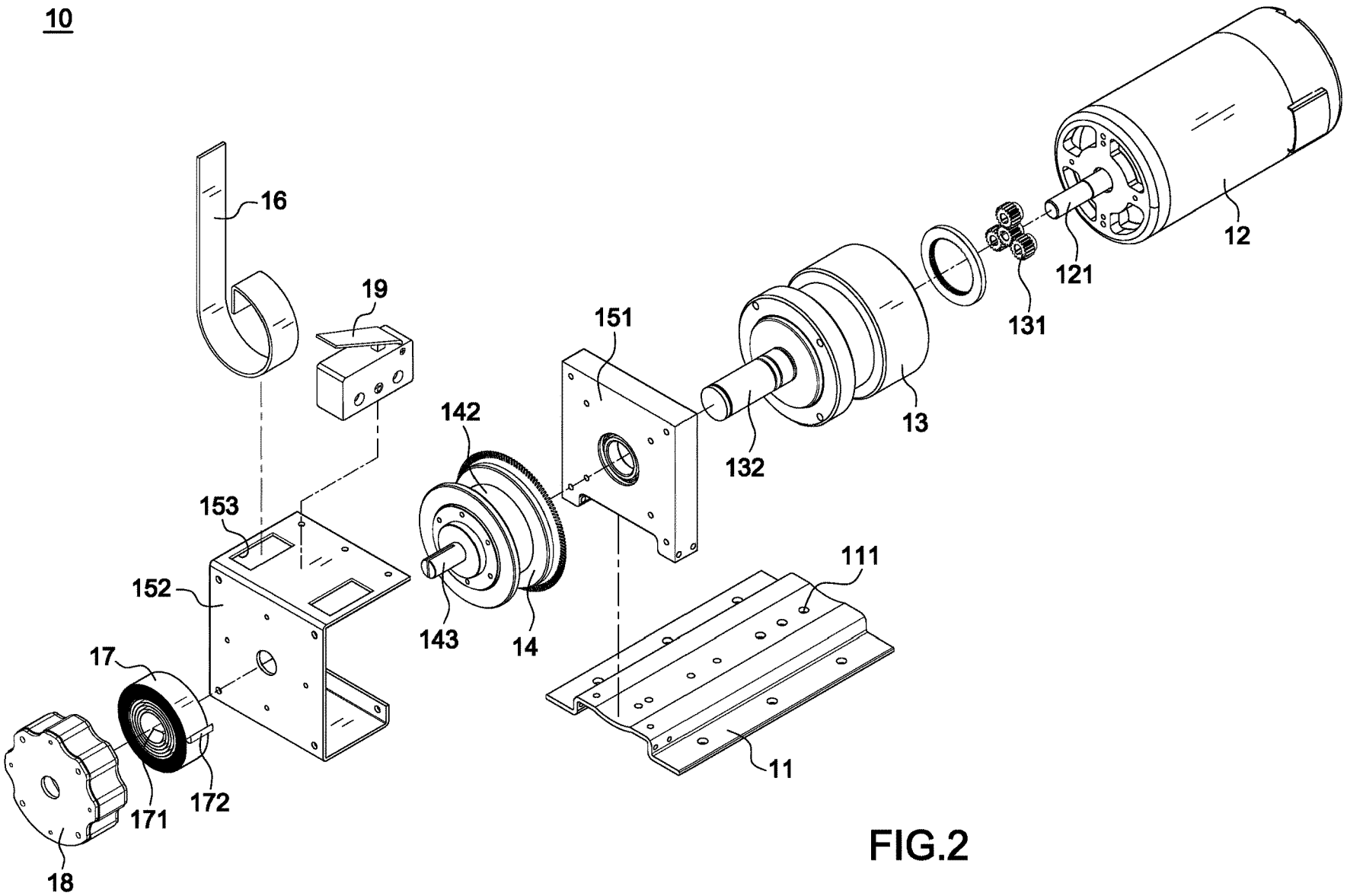
FIG. 2 is an exploded perspective views of the torque producing mechanism in the present invention.
Figure 3:
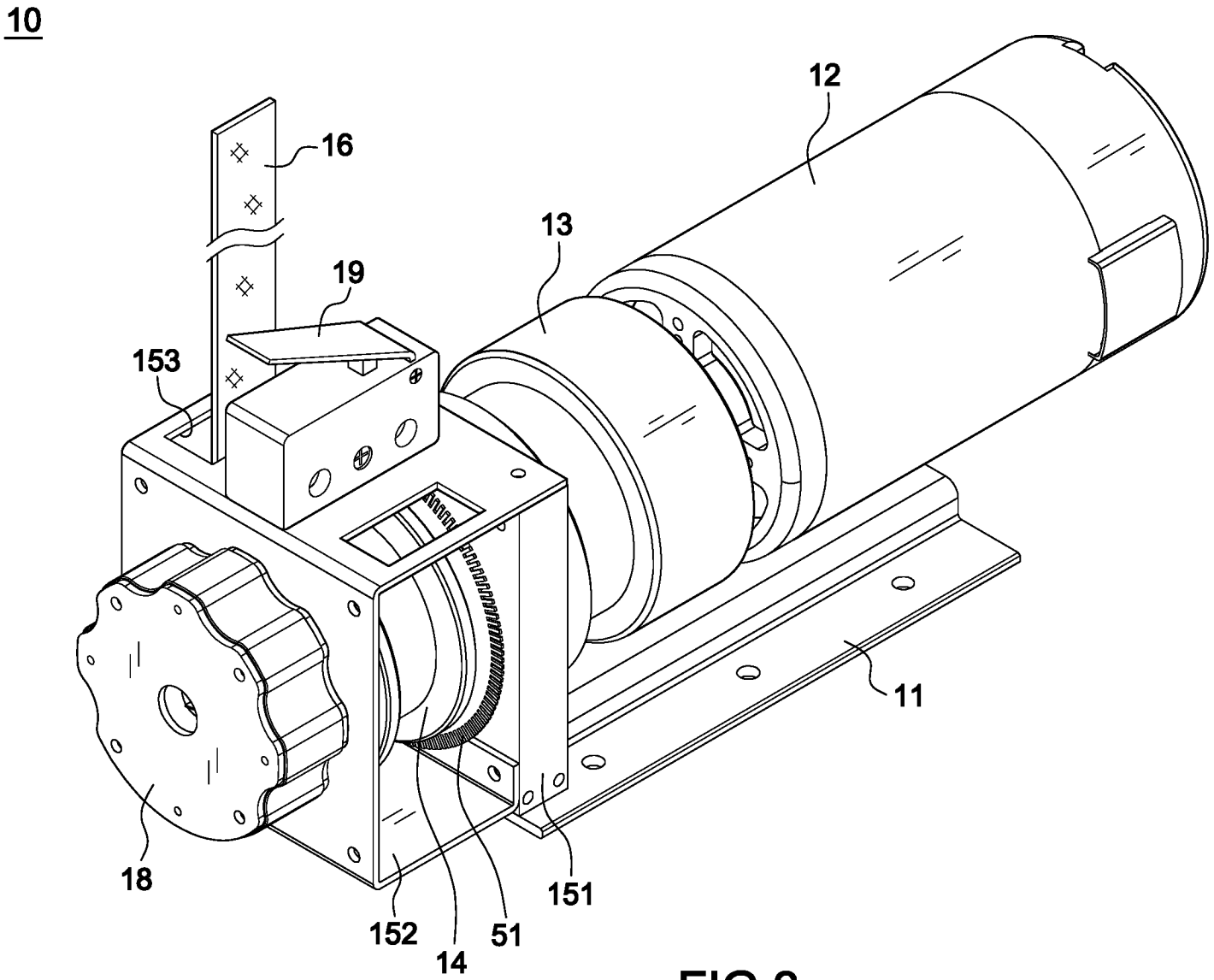
FIG. 3 is an assembly perspective views of the torque producing mechanism in the present invention.
Figure 4:
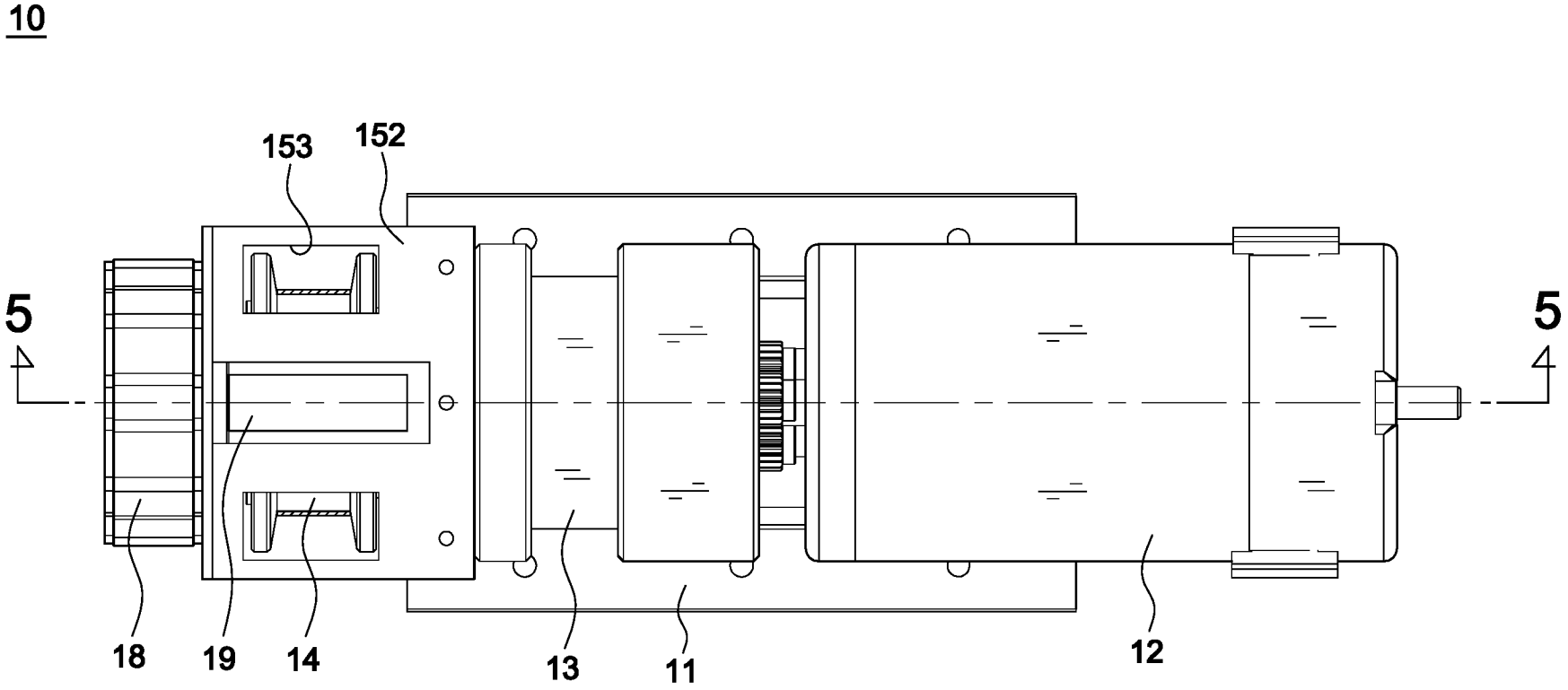
FIG. 4 is an assembly top views of the torque producing mechanism in the present invention.

Referring to FIGS. 2-5, a torque producing mechanism 10 of the present invention, comprising: a motor 12, a deceleration machine 13, and a winding wheel 14, each of them is fixed on the positioning hole 111 of a base plate 11 and connected to each other on the same shaft; wherein the motor 12 is a direct current (DC) motor or a brushless motor which shaft center 121 connected to a speed change gear train 131 of the deceleration machine 13, the deceleration machine 13 having a protruding output shaft 132 with an one-way bearing 133 set in a shaft hole 141 of the winding wheel 14; a belt 16 winding the wheel hub 142 of the winding wheel 14 and connecting to a steel wire 23 at the free end 161, while the steel wire 23 is pulled by the applied force, the motor 12 outputs torque in the opposite direction of the applied force to the steel wire 23; a bracket 151 arranged on the base plate 11 and beside the deceleration machine 13, a fixing bracket 152 with U shape arranged at the lateral side of the bracket 151 and surrounded the winding wheel 14, having an opening hole 153 on the top periphery make the free end 161 of the belt 16 able to pass through the fixing bracket 152; on the lateral side of the winding wheel 14 set a main shaft 143 for connecting the inner end part 171 of a spiral spring 17, and the outer end part 172 fixed on the fixing bracket 152 to form a hook, when the winding wheel 14 is spun by the belt 16 pulling, the winding wheel 14 will tighten the spiral spring 17 and apply torque in opposite direction to the main shaft 143, and when the main shaft 143 rewinding, the one-way bearing 133 set in the shaft hole 142 of the winding wheel 14 will stop the output shaft 132 of the deceleration machine 13 from operating, thus it will not drive the shaft center 121 of the motor 12 to spin, and when the belt 16 stops pulling, the winding wheel 14 will rewind the belt 16 immediately.

The present invention further includes a cover 18 covering the spiral spring 17 for protection; and a microswitch 19 arranged beside the opening hole 153 of the fixing bracket 152, by sensing the movement distance of the belt 16, the microswitch 19 switch on or switch off the motor 12 immediately.

Figure 6:
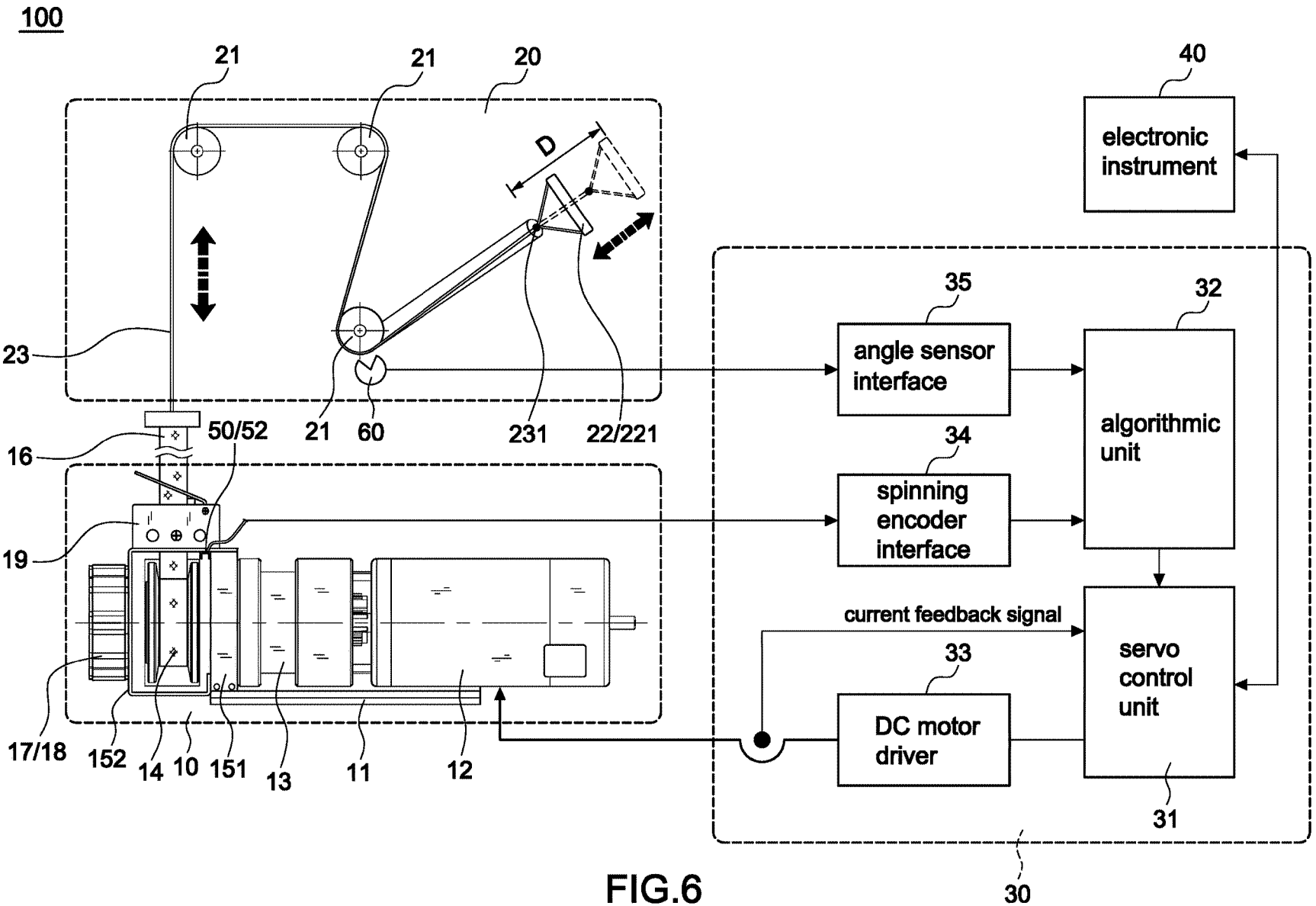
FIG. 6 is a schematic diagram illustrating the assembly structure of the present invention in the first applicable embodiment.
Figure 7:
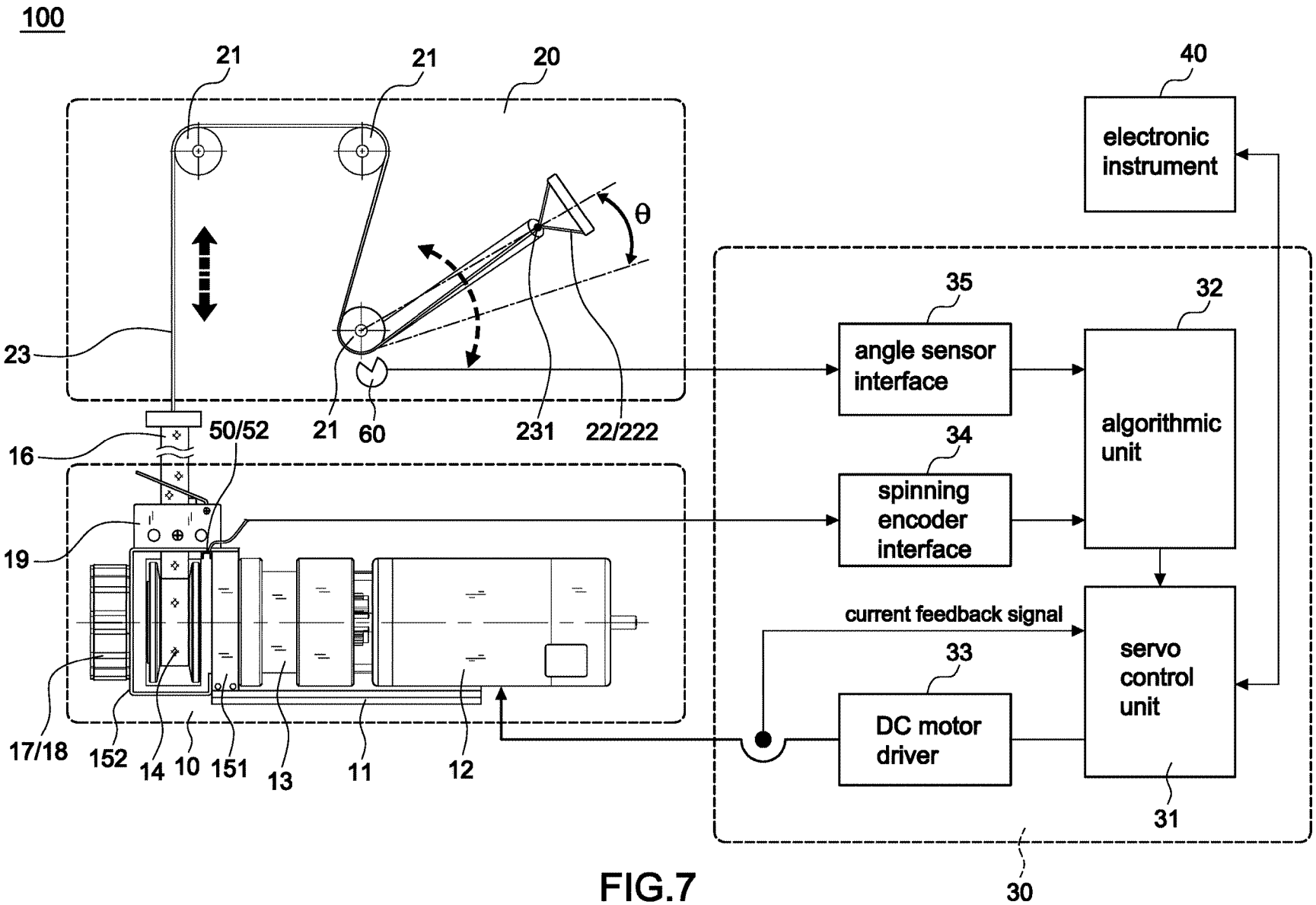
FIG. 7 is a schematic diagram illustrating the assembly structure of the present invention in the second applicable embodiment.

Referring to FIGS. 6-7, the structure of the combination of embodiment 1 and embodiment 2 in the present invention comprising: a torque producing mechanism 10, a weight pulling mechanism 20, a controller 30, and an electronic instrument 40; wherein the structure of the torque producing mechanism 10 is already mentioned above, the weight pulling mechanism 20 having multiple guide pulleys 21 and a force applied unit 22, the steel wire 23 surrounded the guide pulley 21 and the force applied unit 22 connected to the free end 231 makes the torque output by the motor 12 transmit to the force applied unit 22, the force applied unit 22 can be connected to an extension element 221 as FIG. 6 showing, or a swinging element 222 as FIG. 7 showing; the controller 30 with the controlling circuit built-in having: a servo control unit 31, an algorithmic unit 32, a DC motor driver 33, a spinning encoder interface 34, and an angle sensor interface 35, the controller 30 is electrically connected to the motor 12 to adjust the electric current and transmit the signal to the motor 12 and further control the torque of the motor 12; the electronic instrument 40 electrically connected to the controller 30 for inputting the load value and showing the status of movement path.

Figure 5:
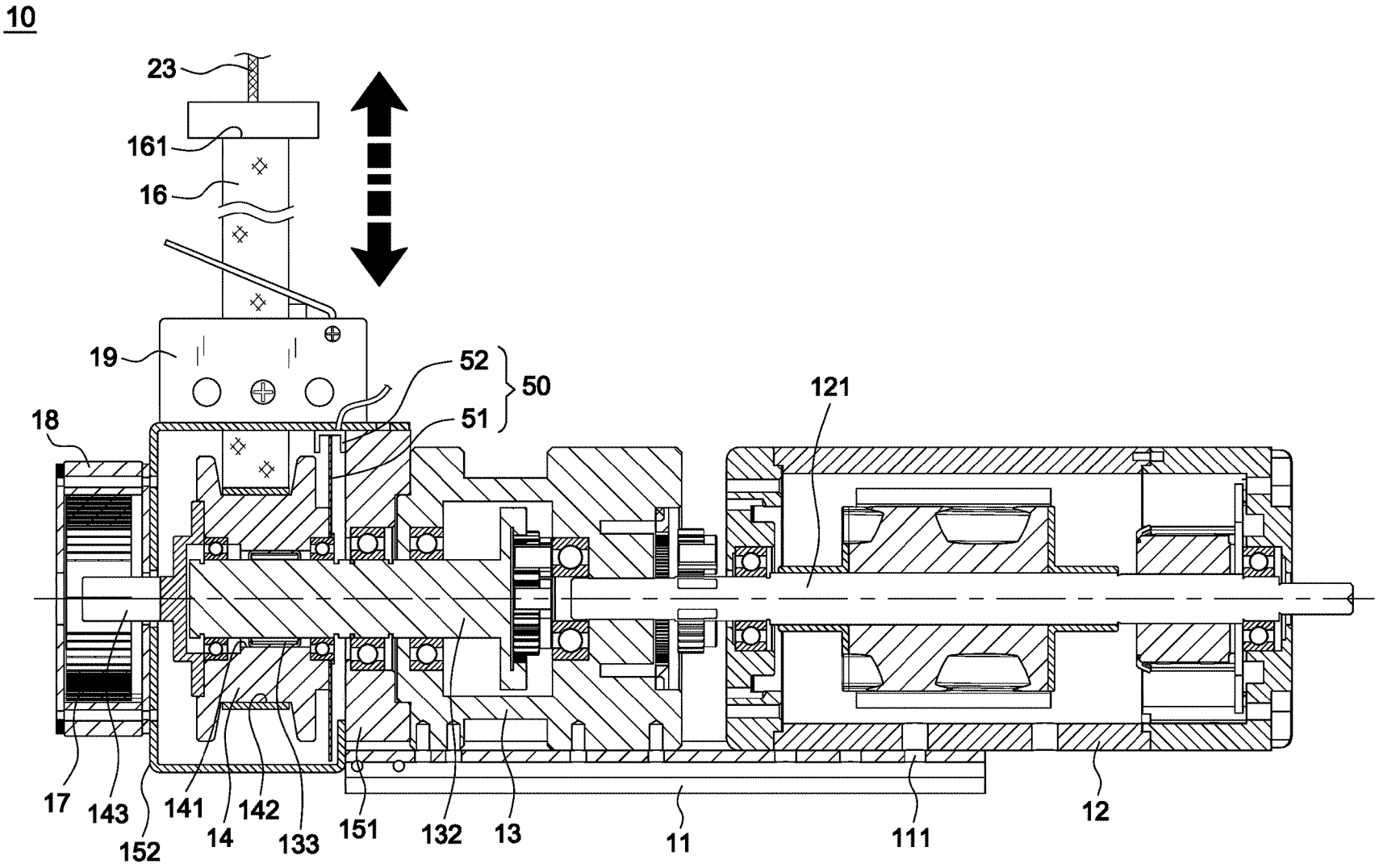
FIG. 5 is an assembly sectional views of the torque producing mechanism in the present invention.
Figure 8:
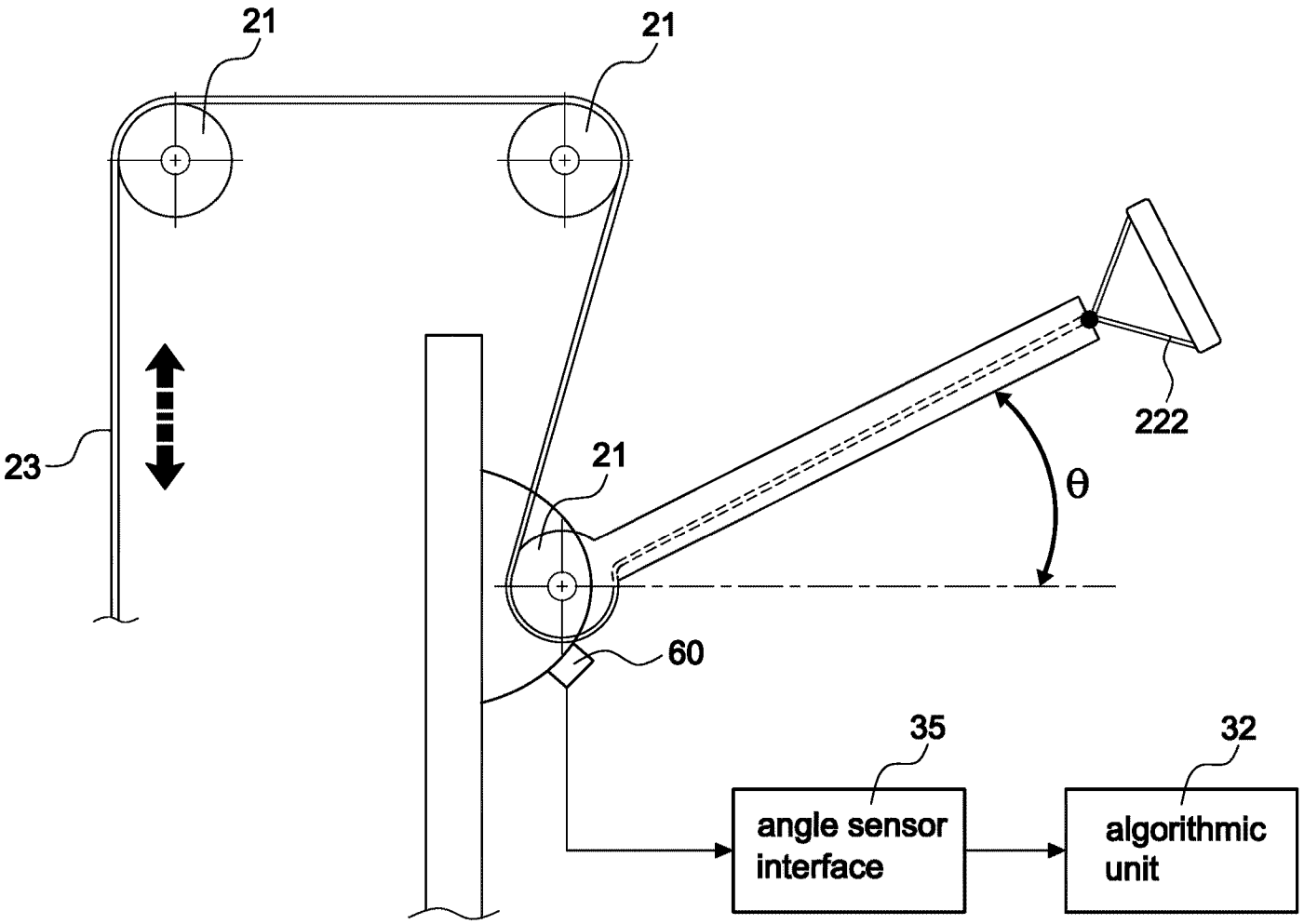
FIG. 8 is a schematic diagram illustrating the operating of the second applicable embodiment.

The present invention further has a movement path sensor 50, including an optical interrupt disk 51 installed at the lateral side of the winding wheel 14 and linked to the winding wheel 14, and a pair of optical couplers 52 installed at the periphery of the optical interrupt disk 51 as FIG. 5 showing, the optical couplers 52 are electrically connected to the spinning encoder interface 34 of the controller 30 as FIG. 6 showing, when applying force to the extension element 221, the extension element 221 moves in a distance D, making the belt 16 drive the winding wheel 14 and the optical couplers 16 to spin synchronously, and the pulse signal produced by the optical couplers 52 transmitted to the spinning encoder interface 34 inside the controller 30, the algorithmic unit 32 calculate the travel distance D and display the result on the screen of the electronic instrument 40; referring to FIGS. 7-8, an angle sensor 60 arranged beside the guide pulley 21 of the weight pulling mechanism 20, and the angle sensor 60 is electrically connected to the angle sensor interface 35 of the controller 30, when apply force to the swinging element 222 causing a swinging with swinging angle Θ, the swinging element 222 drives the guide pulley 21 to spin with the angle Θ, then the angle pulse signal produced by angle sensor 60 transmits to the angle sensor interface 35 of the controller 30, the algorithmic unit 32 calculate the swinging angle Θ and display the result on the screen of the electronic instrument 40; Meanwhile, the pulse signal produced by the optical couplers 52 as FIG. 6 showing, the angle pulse signal produced by angle sensor 60 as FIG. 7 showing, both signal will transmit to the servo control unit to perform a curved load control and appropriately compensate a load current to provide a smooth and real-world setting to users.

Whereby inputting required torque value by electronic instrument 40, the servo control unit 31 will drive the DC motor driver 33 to produce load current, and further drive the motor 12 to spin and output a torque, as FIGS. 6-7 showing; the user will have to against the torque by the steel wire 23 while applying force to the extension element 221 and the swinging element 22, so achieve the effect of strength training; meanwhile, the pulse signal produced by the optical couplers 52 or the angle sensor 60 will be transmitted to the spinning encoder interface 34 or the angle sensor interface 35, after calculating by the algorithmic unit 32, the servo control unit 31 performs a curved load control and appropriately compensate a load current to provide a smooth and real-world setting to users.

In the present invention, the torque producing mechanism 10 having the motor 12, the deceleration machine 13, and the winding wheel 14 are connected to each other in the same shaft on the base plate 11; since there is no need to drive through the belt pulley, the present invention reduces the transmission loss and achieves integral structure and reducing taking up space.

In the present invention, the deceleration machine 13 having a protruding output shaft 132 with an one-way bearing 133 set in a shaft hole 141 of the winding wheel 144, the outer end part 172 fixed on the fixing bracket 152, to form a hook, when the winding wheel 14 is spun by the belt 16 pulling, the winding wheel 14 will tighten the spiral spring 17 and apply torque in opposite direction to the main shaft 143, and when the main shaft 143 rewinding, the one-way bearing 133 set in the shaft hole 142 of the winding wheel 14 will stop the output shaft 132 of the deceleration machine 13 from operating, thus it will not drive the shaft center 121 of the motor 12 to spin, and when the belt 16 stops pulling, the winding wheel 14 will rewind the belt 16 immediately, so achieves the effect of protecting shaft center 121.

In the present invention, a movement path sensor 50 arranged beside the winding wheel 14 electrically connected to the spinning encoder interface 34 of the controller 30, and beside the guide pulley 21 of the weight pulling mechanism 20 arranged an angle sensor 60 electrically connected to the angle sensor interface 35; when the force applied to the force applied unit 22, it will make the winding wheel 14 and the guide pulley 21 to spin, the movement path sensor 50 and the angle sensor 60 produce pulse signal for the servo control unit 31 performing a curved load control and appropriately compensating a load current to provide a smooth and real-world setting to users.

In the present invention, the force applied unit 22 of the weight pulling mechanism 20 can be connected to an extension element 221 or a swinging element 222, the extension element 221 allows the user to do extension training, and the swinging element 222 allows the user to do swinging training, makes the training functions have not only extension mode but also swinging mode.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A strength training equipment, comprising:

a torque producing mechanism having a motor, a deceleration machine having a speed change gear train, and a winding wheel, each fixed on a base plate and connected to each other on a single axis; wherein the motor is a direct current motor or a brushless motor, the motor having a shaft center, the shaft center is connected to the speed change gear train of the deceleration machine, the deceleration machine having a protruding output shaft with an one-way bearing set in a shaft hole of the winding wheel; a belt winding the winding wheel and connecting to a steel wire at a free end, while the steel wire is pulled by an applied force, the motor outputs torque to the steel wire; a fixing bracket surrounded the winding wheel, on a of the fixing bracket set an opening hole making a free end of the belt able to pass through; on a lateral side of the winding wheel set a main shaft for connecting an inner end part of a spiral spring, and an outer end part fixed on the fixing bracket, when the winding wheel is spun by the belt pulling, the winding wheel will tighten the spiral spring and apply torque in opposite direction to the main shaft, and when the main shaft is rewinding, the one-way bearing set in the shaft hole of the winding wheel will stop the output shaft of the deceleration machine from operating, and will not drive the shaft center of the motor to spin, and when the belt stops pulling, the winding wheel will rewind the belt immediately;

a weight pulling mechanism having multiple guide pulleys and a force applied unit, the steel wire surrounded the guide pulley and the force applied unit connected to a free end makes the torque output by the motor transmit to the force applied unit, the force applied unit can be connected to an extension element or a swinging element;

a controller with a controlling circuit built-in having: a servo control unit, an algorithmic unit, a DC motor driver, a spinning encoder interface, and an angle sensor interface, the controller is electrically connected to the motor to adjust the electric current and transmit the signal to the motor and further control the torque of the motor;

an electronic instrument electrically is connected to the controller for inputting a load value and showing a status of movement path;

a movement path sensor, including an optical interrupt disk installed at the lateral side of the winding wheel and linked to the winding wheel, and a pair of optical couplers installed at a periphery of the optical interrupt disk, the optical couplers are electrically connected to the controller, when applying force to the extension element, makes the belt drive the winding wheel and the optical couplers to spin synchronously, and a pulse signal produced by the optical couplers will be transmitted to the spinning encoder interface of the controller; an angle sensor arranged beside the guide pulley of the weight pulling mechanism, and the angle sensor is electrically connected to the controller, when applying force to the swinging element, will make the steel wire drive the guide pulley to spin, then an angle pulse signal will be transmitted to the angle sensor interface of the controller;

whereby when inputting required torque value by electronic instrument, the servo control unit will drive the DC motor driver to produce load current, and further drive the motor to spin and output torque, a user will have to against the torque while applying force to the extension element and the swinging element, so achieve the effect of strength training; meanwhile, the pulse signal produced by the optical couplers or the angle sensor will be transmitted to the spinning encoder interface or the angle sensor interface, after calculating by the algorithmic unit, the servo control unit performs a curved load control and appropriately compensates the load current to provide a smooth and real-world setting to the user.

2. The strength training equipment as claimed in claim 1, wherein further comprising a microswitch arranged beside the opening hole of the fixing bracket, by sensing the movement distance of the belt, the microswitch switch on or switch off the motor immediately.

3. The strength training equipment as claimed in claim 1, wherein further comprising a cover covering the spiral spring for protection.

* * * * *